US009623318B2

(12) United States Patent
Yang et al.

(10) Patent No.: US 9,623,318 B2
(45) Date of Patent: Apr. 18, 2017

(54) ICY TABLE

(71) Applicant: RIS SPORTS (GUANGZHOU) CO., LTD, Guangzhou (CN)

(72) Inventors: Fan Yang, Guangzhou (CN); Kwun Po Leung, H. K. (CN)

(73) Assignee: RIS SPORTS (GUANGZHOU) CO., LTD, Guangzhou (CN)

( * ) Notice: Subject to any disclaimer, the term of this patent is extended or adjusted under 35 U.S.C. 154(b) by 0 days.

(21) Appl. No.: 14/939,050

(22) PCT Filed: Nov. 21, 2014

(86) PCT No.: PCT/CN2014/091866
§ 371 (c)(1),
(2) Date: Nov. 12, 2015

(87) PCT Pub. No.: WO2016/058242
PCT Pub. Date: Apr. 21, 2016

(65) Prior Publication Data

US 2016/0287981 A1 Oct. 6, 2016

(30) Foreign Application Priority Data

Oct. 14, 2014 (CN) ..... 2014 2 0590795 U

(51) Int. Cl.
*A47B 85/00* (2006.01)
*A63F 7/06* (2006.01)
(Continued)

(52) U.S. Cl.
CPC ..... *A63F 7/0672* (2013.01); *A47B 13/023* (2013.01); *A47B 13/12* (2013.01); *A47B 25/00* (2013.01); *A47B 31/02* (2013.01); *A47B 37/00* (2013.01); *A47B 97/00* (2013.01); *A63F 7/06* (2013.01); *A63F 7/0616* (2013.01); *F25D 3/02* (2013.01); *F25D 3/06* (2013.01); *A47B 2013/024* (2013.01); *A47B 2220/0008* (2013.01); *A63F 2003/00974* (2013.01); *A63F 2009/0056* (2013.01);
(Continued)

(58) Field of Classification Search
CPC ..... A63F 7/0672; A63F 7/0616; F25D 3/06; F25D 2303/081; A47B 13/023; A47B 13/12; A47B 2013/024
USPC ..... 108/24, 25, 90, 50.18; 273/309, 108.1
See application file for complete search history.

(56) References Cited

U.S. PATENT DOCUMENTS 184,340 A * 11/1876 Cassiano ..... A47B 13/00 108/24
3,496,887 A * 2/1970 Dupont ..... A63F 1/06 108/25
(Continued)

*Primary Examiner* — Jose V Chen
(74) *Attorney, Agent, or Firm* — Shimokaji IP

(57) ABSTRACT

An icy table relating to a field of movable refrigerated containers includes a base, a support column, an ice bucket, and an amusement table, the base is connected to a lower end of the support column, the amusement table is configured on an upper end of the support column, and the amusement table includes a drinks holder and a game table. The icy table includes an ice bucket and an amusement table, which not only has a function of cooling drinks, but also has amusement function, and the multifunctional icy table can broaden the application areas, improve the practicality and lasting appeal, and promote the use thereof.

8 Claims, 3 Drawing Sheets

(51) Int. Cl.

| | |
|---|---|
| ***A47B 31/02*** | (2006.01) |
| ***F25D 3/06*** | (2006.01) |
| ***A47B 13/02*** | (2006.01) |
| ***A47B 13/12*** | (2006.01) |
| ***A47B 37/00*** | (2006.01) |
| ***A47B 25/00*** | (2006.01) |
| ***A47B 97/00*** | (2006.01) |
| ***F25D 3/02*** | (2006.01) |
| *A63F 9/00* | (2006.01) |
| *A63F 3/00* | (2006.01) |

(52) U.S. Cl.
CPC .. *F25D 2303/081* (2013.01); *F25D 2331/803* (2013.01); *F25D 2331/809* (2013.01)

(56) References Cited

U.S. PATENT DOCUMENTS 3,932,009 A * 1/1976 Zollinger ..... A47B 9/04 108/147
3,979,156 A * 9/1976 Gross ..... A47B 13/12 108/91
4,023,379 A * 5/1977 Zevlakis ..... F25D 23/12 254/394
4,762,327 A * 8/1988 Gomez ..... A47B 25/00 108/50.13
4,848,091 A * 7/1989 Border ..... A47B 69/00 62/258
4,876,969 A * 10/1989 Infanti ..... A47B 31/00 108/23
4,901,998 A * 2/1990 Griffith ..... A63G 23/00 108/150
5,143,108 A * 9/1992 Kenney ..... A45B 3/00 108/151
5,326,102 A * 7/1994 Chang ..... A63F 7/0672 108/161
D368,387 S * 4/1996 Bureau ..... D6/686
D376,068 S * 12/1996 Coy ..... D7/388
6,364,329 B1 * 4/2002 Holub ..... A45C 5/14 280/47.26
7,908,977 B2 * 3/2011 Zak ..... A47B 31/02 108/24
8,166,893 B2 * 5/2012 Davis ..... A47B 13/086 108/26
8,188,410 B2 * 5/2012 Dean ..... A47B 3/0911 108/115
2007/0012223 A1 * 1/2007 Flusche ..... A45B 3/00 108/26

* cited by examiner

ICY TABLE

FIELD OF THE INVENTION

The present invention relates to a field of movable refrigerated containers, more particularly to a multifunctional icy table, which is convenient to use.

BACKGROUND OF THE INVENTION

Conventional football tables all have the same structure and single function, which just can be distinguished in appearance. Icy table is a container adapted for receiving drinks, which is a simple container for cooling drinks or wine by ice.

SUMMARY OF THE INVENTION

One objective of the present invention is to provide an icy table having functions of cooling drinks and amusement, thereby broadening the application areas thereof.

To achieve the above objective, an icy table of the present invention includes a base, a support column, and an amusement table, the base is connected to a lower end of the support column, the amusement table is configured on an upper end of the support column, and the amusement table includes a drinks holder and a game table.

Further, the icy table further includes an ice bucket movably configured at a middle part of the support column.

Further, the ice bucket has a basin-shaped structure with an upward opening.

Further, the amusement table has a basin-shaped structure with an upward opening, a first tabletop is configured on the opening of the amusement table, and the game table for playing football dolls board game is configured in the basin-shaped structure of the amusement table.

Further, a ball-picking opening and an inlet for kicking off and controlling gamepads are configured at sides of the amusement table.

Further, the amusement table, the ice bucket layer, and the first tabletop are made of plastic material, glass fiber reinforced plastics, tempered glass, or metal.

Further, a second tabletop is configured above the amusement table, a hole is opened in the second tabletop, and the drinks holder is formed by the first tabletop and the hole of the second tabletop.

Further, the second tabletop is made of transparent glass fiber reinforced plastics, tempered glass, acrylic sheet, or polystyrene sheet.

Further, a support pole is configured between the second tabletop and the first tabletop for supporting the second tabletop and connecting the second tabletop to the first tabletop.

Further, the ice bucket has a drain opening configured at the bottom thereof.

In comparison with the prior art, the icy table includes an ice bucket and an amusement table, which not only has a function of cooling drinks, but also has amusement function, the multifunctional icy table can broaden the application areas, improve the practicality and lasting appeal, and promote the use thereof.

BRIEF DESCRIPTION OF THE DRAWINGS

The accompanying drawings facilitate an understanding of the various embodiments of this invention. In such drawings.

Figure 1:
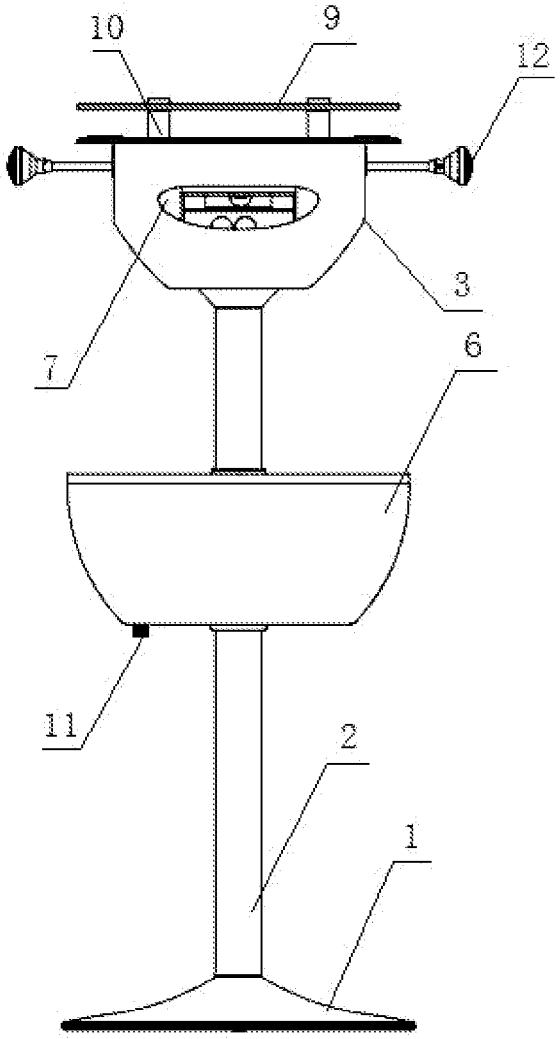
FIG. 1 is a front view of the icy table of the present invention.

Wherein:

1, base
2, support column
3, amusement table
4, drinks holder
5, game table
6, ice bucket layer
7, ball-picking opening
8, inlet for kicking off and controlling gamepads
9, second tabletop
10, support pole
11, drain opening
12, gamepad

DETAILED DESCRIPTION OF ILLUSTRATED EMBODIMENTS

Various embodiments of this invention will be described below referring to the accompanying drawings of the present invention, while, the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

In the following description, numerous specific details are set forth in order to fully understand the present invention, but the present invention can also be applied in other ways different from the described ways, a person skilled in the art may change within the spirit of the invention, therefore the prevent invention is not to be limited to the following disclosed embodiments.

Figure 2:
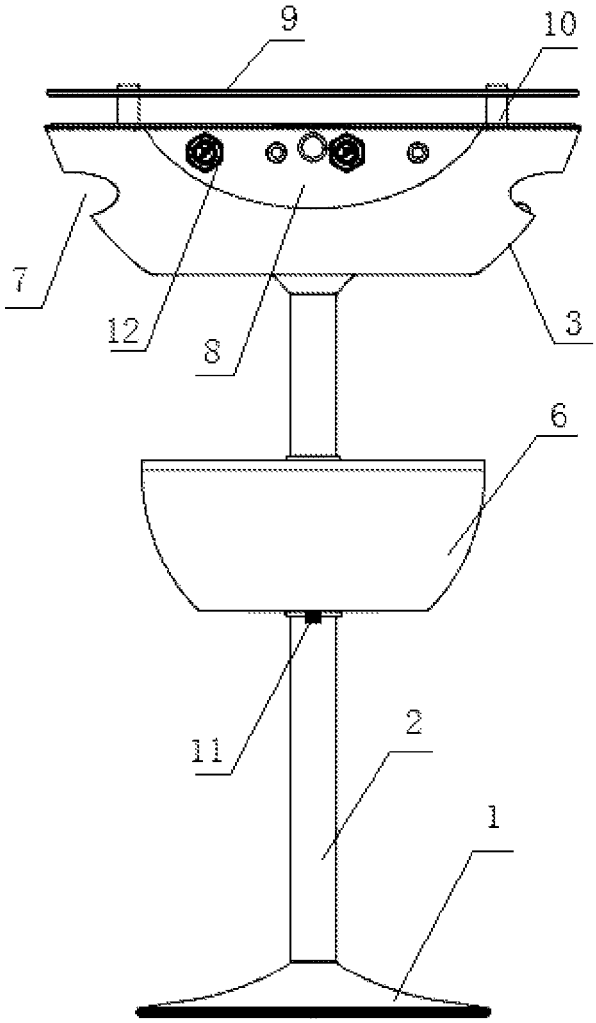
FIG. 2 is a side view of the icy table of the present invention.
Figure 3:
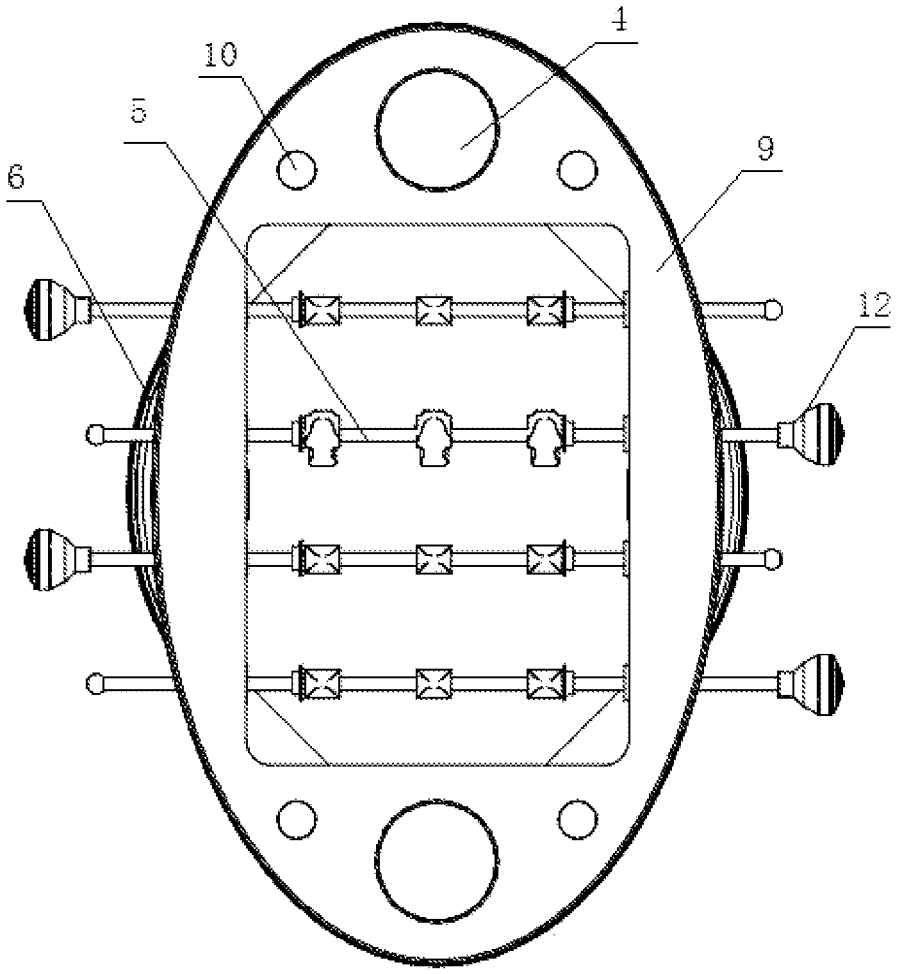
FIG. 3 is a top view of the icy table of the present invention.

As illustrated in FIGS. 1-3, the icy table according to the present invention includes a base 1, a support column 2, an ice bucket 6, and an amusement table 3. The base 1 is connected to a lower end of the support column 2, the ice bucket 6 is movably configured at a middle part of the support column 2, and the ice bucket 6 has ice placed therein for cooling drinks, bottle wine, and so on. Concretely, the ice bucket 6 has a basin-shaped structure with an upward opening, and has a drain opening 11 configured at the bottom thereof for releasing water melted from ice. The ice bucket 6 is made of plastic material, glass fiber reinforced plastics, tempered glass or metal.

The amusement table 3 is configured on an upper end of the support column 2, and the amusement table 3 having a drinks holder 4 and a game table 5. Concretely, the amusement table 3 has a basin-shaped structure with an upward opening, a first tabletop is configured on the opening of the amusement table 3, the first tabletop is made of plastic material, glass fiber reinforced plastics, tempered glass or metal, and the game table 5 for playing football dolls board game is configured in the basin-shaped structure of the amusement table 3.

A ball-picking opening 7 and an inlet 8 for kicking off and controlling gamepads adapted for picking up balls and operating gamepads are configured at sides of the amusement table 3. The amusement table 3 is made of plastic material so as to be easy to observe the position of the balls, in other embodiment, the amusement table 3 can be made of glass fiber reinforced plastics, tempered glass, or metal. A second tabletop 9 is configured above the amusement table 3, a hole is opened in the second tabletop 9, and the drinks holder 4 is formed by the first tabletop and the hole of the second tabletop 9. The second tabletop 9 is made of plastic material, transparent glass fiber reinforced plastics, tempered glass, acrylic sheet, or polystyrene sheet. A support pole 10 is configured between the second tabletop 9 and the first tabletop for supporting the second tabletop 9 and connecting the second tabletop 9 to the first tabletop.

The icy table is a combination product having practicality and amusement. The new design thereof provides a unique visual impact, and combined functions bring inventive usability and practicality. The top of the product is configured with the tabletop and the amusement table, wherein the tabletop is made of transparent tempered glass that is hard and durable, and drinks holder adapted for placing bottle and cup has been configured at both ends thereof. This structure can prevent objects on the tabletop from falling down; in addition, the transparent tabletop would not affect the operation of the game table. The handles of the gamepads is made of flexible glue and formed by post-forming process, non-slip material combined with simple and humanized design thereof provide users with a more comfortable and easy-to-use experience.

The middle of the product is provided with the ice bucket layer, the suspended ice bucket is shaped to be round to facilitate taking objects from any position or angle. Round and smooth shape thereof gives the users a friendly and safe feeling, and can prevent the users from hurt. The drain opening configured at the bottom thereof is used for releasing water in use or after use.

The base is in a shape of disc, the support column is in a shape of an iron pipe, and the base and the support column firmly support the entire product. The disc-shaped base is fashionable and also convenient to be moved. The tabletop is made of tempered glass, and may crumble into honeycomb-like and obtuse angle particles under external force, which is difficult to hurt users seriously. The impact strength of the tempered glass is 3-5 times of that of ordinary glass with the same thickness, and the bending strength is also 3-5 times of that of the ordinary glass. The tempered glass has good thermal stability and can withstand a temperature change ranging within 300° C., and the temperature difference thereof is 3 times of that of the ordinary glass.

In another embodiment, the ice bucket and the tabletop are made of high-strength resin material that is a high strength, good toughness, and easy processing thermoplastic polymer material. The support column and the base are made of iron, and then sprayed with powder or galvanized to improve corrosion resistance.

In sum, the icy table not only has a function of cooling drinks, but also has amusement function, and the multifunctional icy table can broaden the application areas, improve the practicality and lasting appeal, and promote the use thereof.

What is claimed is:

1. An icy table, comprising a base (1), a support column (2), and an amusement table (3), the base (1) being connected to a lower end of the support column (2), the amusement table (3) being configured on an upper end of the support column (2), and the amusement table (3) comprising a drinks holder (4) and a game table (5);

wherein the amusement table (3) has a basin-shaped structure with an upward opening, a first tabletop is configured on the opening of the basin-shaped structure, and the game table (5) for playing football dolls board game is configured in the basin-shaped structure of the amusement table (3);

wherein a second tabletop (9) is configured above the first tabletop, a hole is opened in the second tabletop (9), and the drinks holder (4) is formed by the first tabletop and the hole of the second tabletop (9).

2. The icy table according to claim 1, wherein the icy table further comprises an ice bucket (6) movably configured at a middle part of the support column (2).

3. The icy table according to claim 2, wherein the ice bucket (6) has a basin-shaped structure with an upward opening.

4. The icy table according to claim 2, wherein the amusement table (3), the ice bucket (6), and the first tabletop are made of plastic material, glass fiber reinforced plastics, tempered glass, or metal.

5. The icy table according to claim 2, wherein the ice bucket (6) has a drain opening (11) configured at the bottom thereof.

6. The icy table according to claim 1, wherein a ball-picking opening (7) and an inlet (8) for kicking off and controlling gamepads are configured at sides of the amusement table (3).

7. The icy table according to claim 1, wherein the second tabletop (9) is made of transparent glass fiber reinforced plastics, tempered glass, acrylic sheet, or polystyrene sheet.

8. The icy table according to claim 1, wherein a support pole (10) is configured between the second tabletop (9) and the first tabletop for supporting the second tabletop (9) and connecting the second tabletop (9) to the first tabletop.

* * * * *